US005831554A

United States Patent [19]

Hedayat et al.

[11] Patent Number: 5,831,554

[45] Date of Patent: Nov. 3, 1998

[54] ANGULAR POSITION SENSOR FOR PIVOTED CONTROL DEVICES

[75] Inventors: Kayvan Hedayat, Chestnut Hill; Gerald A. Tromblee, Hanover, both of Mass.

[73] Assignee: Joseph Pollak Corporation, Boston, Mass.

[21] Appl. No.: 925,298

[22] Filed: Sep. 8, 1997

[51] Int. Cl.[6] ..... G05G 9/00

[52] U.S. Cl. ..... 341/20; 200/6 A; 74/471 XY; 324/207.2; 345/161

[58] Field of Search ..... 341/20; 74/471 XY; 200/6 R, 6 A; 345/161; 324/207.2, 207.16

[56] References Cited

U.S. PATENT DOCUMENTS

| | | | |
|---|---|---|---|
| 4,107,604 | 8/1978 | Bernier | 324/208 |
| 4,825,157 | 4/1989 | Mikan | 324/208 |
| 5,140,292 | 8/1992 | Stolfus | 324/207.2 |
| 5,159,268 | 10/1992 | Wu | 324/307.02 |
| 5,176,041 | 1/1993 | Meier et al. | 74/471 |
| 5,264,668 | 11/1993 | Alfors | 324/307.2 |
| 5,286,024 | 2/1994 | Winblad | 273/148 B |
| 5,421,694 | 6/1995 | Baker et al. | 74/471 XY |
| 5,491,462 | 2/1996 | Checchi et al. | 338/128 |
| 5,619,195 | 4/1997 | Allen et al. | 341/20 |

*Primary Examiner*—Michael Horabik
*Assistant Examiner*—Albert K. Wong
*Attorney, Agent, or Firm*—Kenway & Crowley

[57] ABSTRACT

A non-contact angular position sensor for sensing the position of a pivotably mounted device, which includes a housing containing a generally spherical socket having a relatively large pivot ball mounted for rotation in the socket, the ball including a spherical magnet having its center coincident with that of the pivot ball, magnetic sensing elements cooperating with and mounted at a fixed distance from the magnet, a joystick having its axis passing through the center of the spherical magnet, and output apparatus connected to the magnetic sensing elements to provide a signal representative of the orientation of the joystick.

8 Claims, 7 Drawing Sheets

ANGULAR POSITION SENSOR FOR PIVOTED CONTROL DEVICES

The present invention relates in general to an angular position sensor and more particularly to a non-contact angular position sensor for sensing the position of a pivotally mounted device, such as a joystick. The invention applies to a single axis as well as a two-axis pivotally mounted device particularly useful in heavy equipment applications that require rugged, durable and reliable pivotally mounted joysticks.

BACKGROUND OF THE INVENTION

In the fields of earth moving, logging, construction, agriculture, mining, and other heavy-duty operations, the machinery used often must perform several complex functions. Early on, each separate function was often controlled by a single hydraulic cylinder and each cylinder was individually controlled by a lever, pedal, or switch at the operator's position. In one example of difficult controls in the. logging industry, described in U.S. Pat. No. 5,107,997, a grapple-yarder has three brake pedals, two hand levers, three hand-operated toggle valves, and a knee-activated throttle. Simultaneous operation of several of these controls as frequently required is a challenge to any operator, and long and extensive training is required. In the function of log retrieval, for example, the operator is engaged in a furious pace of arm and leg movement. Not only is the physical strain great, the operator is also hard-put to timely make the awkward and physically demanding movements that are required lest a miscue be made and the operation interrupted with the loss of production and downtime on the machine.

In the face of the obvious need for improvement, a simpler control generally known as a joystick has been developed. The joystick generally includes a plurality of switches and is capable of angular movement in one or more directions. The device derives its name from the familiar aircraft control which it resembles. Each joystick usually triggers a controller which signals the various hydraulic activators of the machine to respond in a suitable fashion. Several arrangements have been developed to translate and computerize the joystick motion, and considerable success has been achieved by the substitution of the joystick for the multiple levers and pedals of the older heavy equipment.

A review of some recent work in the field which provides background for the present invention is found in an article on Equipment Trends by Walt Moore in the September 1995 edition of "Construction Equipment". The article is generally laudatory and avoids mention of the early failure or inefficient operation of the devices resulting from the rough handling and the hostile environment to which the control systems are exposed. These disadvantages indicate the need for increased strength and better protection of the control system joysticks. Moreover, many of the devices currently in use do not provide the operator with the desired sensitivity in detecting position of functional components of the equipment, especially neutral position, needed for efficient and accurate operation.

Accordingly, it is the primary object of the present invention to provide a more reliable and durable joystick control for heavy-duty machinery applications.

Another object of the present invention is to provide a control for sensing two-axis angular position of a pivotally mounted device such as those used in joystick applications.

A further object of the present invention is to provide a two-axis angular position sensor that utilizes a single magnet disposed at the center of rotation of the pivot of a control.

Yet a further object of the present invention is to provide a non-contact two-axis angular position sensor that utilizes a fixed air gap.

A still further object of the present invention is to provide a two-axis angular position sensor that does not require flux concentrators and which provides a generally linear output over a relatively wide angular range and over a relatively wide temperature range.

Another general object of the present invention is to increase the strength of joystick controls.

Yet a further object of the present invention is to provide a detent system having a subtle "feel" which enables the operator to sense the position of the joystick along the X and Y axes of its travel and in which the operator senses extreme joystick positions.

Yet another object of the present invention is to provide a joystick control that is entirely sealed against environmental conditions by the use of multi-level sealing protection of the pivotally mounted joystick shaft and the use of compressed gaskets.

SUMMARY OF THE INVENTION

Briefly, the present invention involves an angular position sensor for sensing the two-axis angular position of a pivotally mounted device such as a two-axis joystick.

A joystick similar to the type in which this invention finds use is disclosed in application Ser. No. 08/620,910, filed Mar. 25, 1996 and entitled "Machine Control System". The application is assigned to the same assignee as the present application, and its disclosure is incorporated herein by reference.

A feature of this invention is the shape and position of the magnet carried by the pivotally mounted shaft of the joystick. By positioning the magnet on the axis of the shaft and at the center of the pivot and forming the outer surface of the magnet with a primarily spherical shape, a fixed air gap is maintained between the magnet and the sensors, which are magnetically sensitive devices such as Hall effect integrated circuits fixedly disposed relative to the magnet. The present assembly accomplishes this by using a spherical pivot split into two primary spherical ball halves hollowed out to accept the magnet, which is positioned such that the center of the magnet is on the axis of the joystick shaft at the center of the two ball halves. The two ball halves also have a plurality of slots formed in them to provide clearance for the sensors to reach inside the hollow ball and maintain a close and fixed proximity to the magnet and to aid in assembly of the unit. A minimum of two sensors are required with this sensing method to define the angular position of the pivotally mounted two-axis sensing device, with additional sensors allowing a redundant check of the angular position.

The superior strength and operator feel are obtained by utilizing a housing having a base, a cover, and walls which incorporate strengthening ribs wherever dictated by stress analysis. A pivot surface of spherical shape accommodates a joystick pivot mechanism including a shaft, split-spherical ball pivot, and magnet. Metal stop members are located above and below the pivot point at a distance maximized in the assembly so as to counteract large forces that may be applied to the end of the joystick handle. Such loads are transmitted through the joystick shaft to the stops and through the cover and base assembly. Also, a spring loaded detent mechanism is provided which incorporates a smaller ball that rides on a concave surface in which steps and rails are formed to give the operator a subtle detent feel as to joystick position along the X and Y axes and at the end of travel. The detent also provides a potential locking feature. For a better understanding of the present invention, together with other and further objects, features and advantages, reference should be made to the following description of a preferred embodiment which should be read with reference to the appended drawing in which:

DETAILED DESCRIPTION OF THE PREFERRED EMBODIMENT

Figure 1:
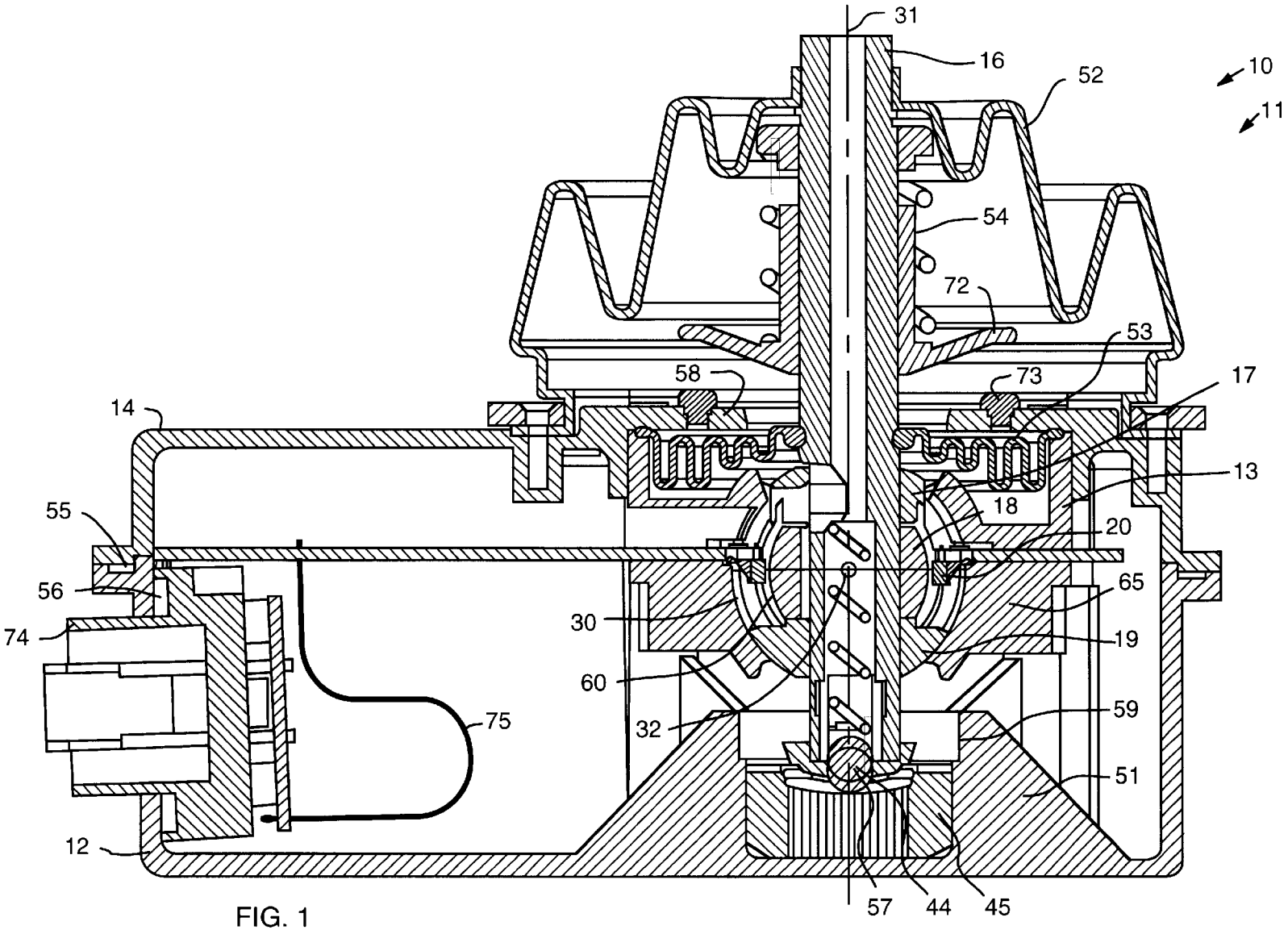
FIG. 1 is a sectional view of a joystick shown with both the pivotal axes shown at the center or neutral position in accordance with the present invention.

In FIG. 1 of the drawing, the angular position sensor of this embodiment of the present invention is generally identified by the reference numeral 10. As will be appreciated by those of ordinary skill in the art, the two-axis angular position sensor 10 is adapted to be used in various applications for providing a signal representative of the angular position of a pivotally mounted device. The angular position sensor 10 is illustrated and discussed below in an application as a joystick.

With reference to FIG. 1, the angular position sensor is disposed in its own housing 11 that consists primarily of a base 12, a cover 14, upper ball housing 13, and lower ball housing 65, as well as an assembly including a joystick which has a handle mounted on a shaft or drive arm 16, an upper ball half 17, a lower ball half 19, and a spherical magnet 18 pivotally mounted on the drive arm 16 relative to the housing 11. Sensors 20 are mounted in fixed relationship to the housing 11, and may be connected electrically to a device to be controlled through the connector 66 which is sealed in the end wall of the housing 11. The magnet 18 and sensors 20 are located inside a spherical pivot surface 30 which is formed on a member held in the base 12.

Figure 3:
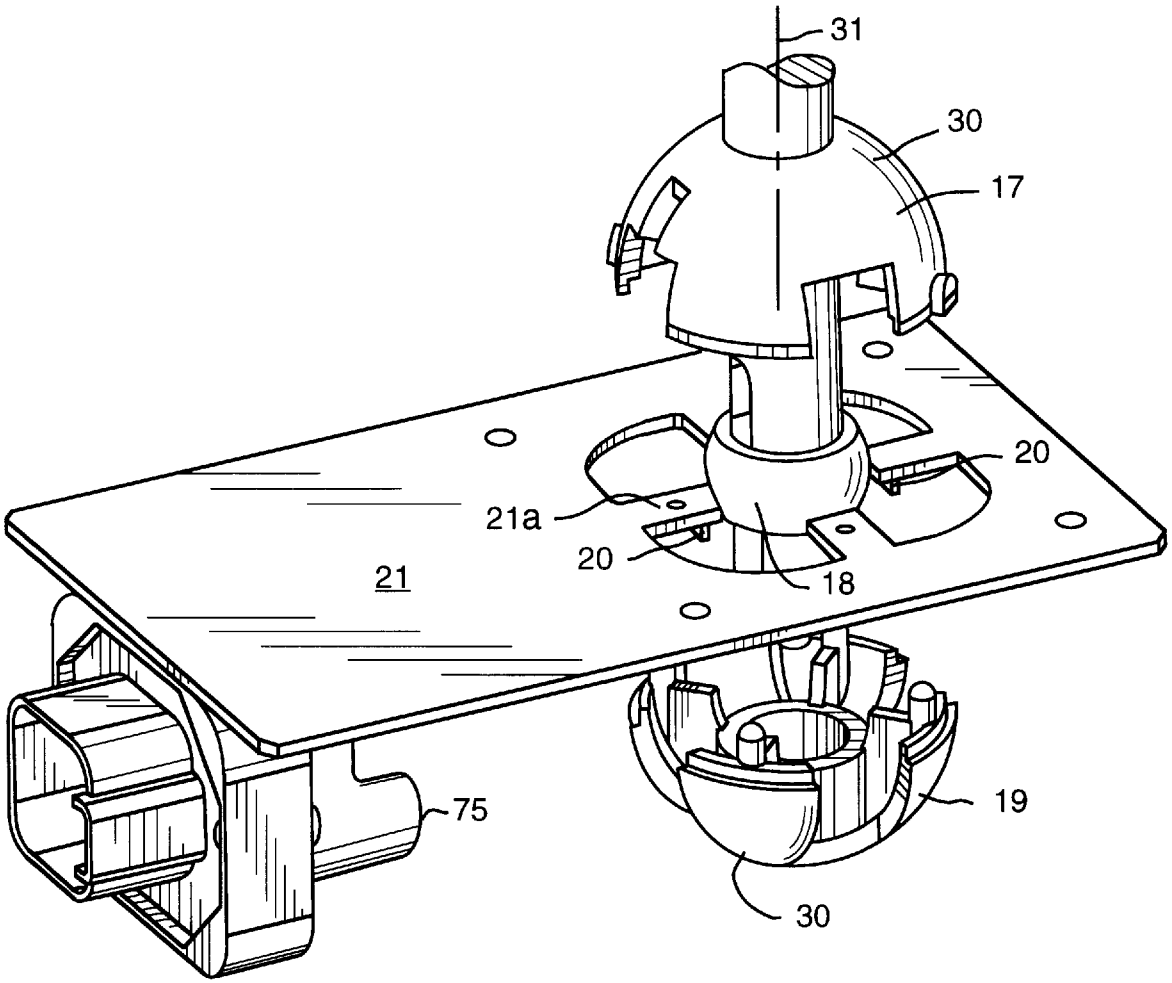
FIG. 3 is an exploded perspective view showing the magnet, drive arm, ball halves, printed circuit board and sensor orientation as incorporated in the present invention.
Figure 4:
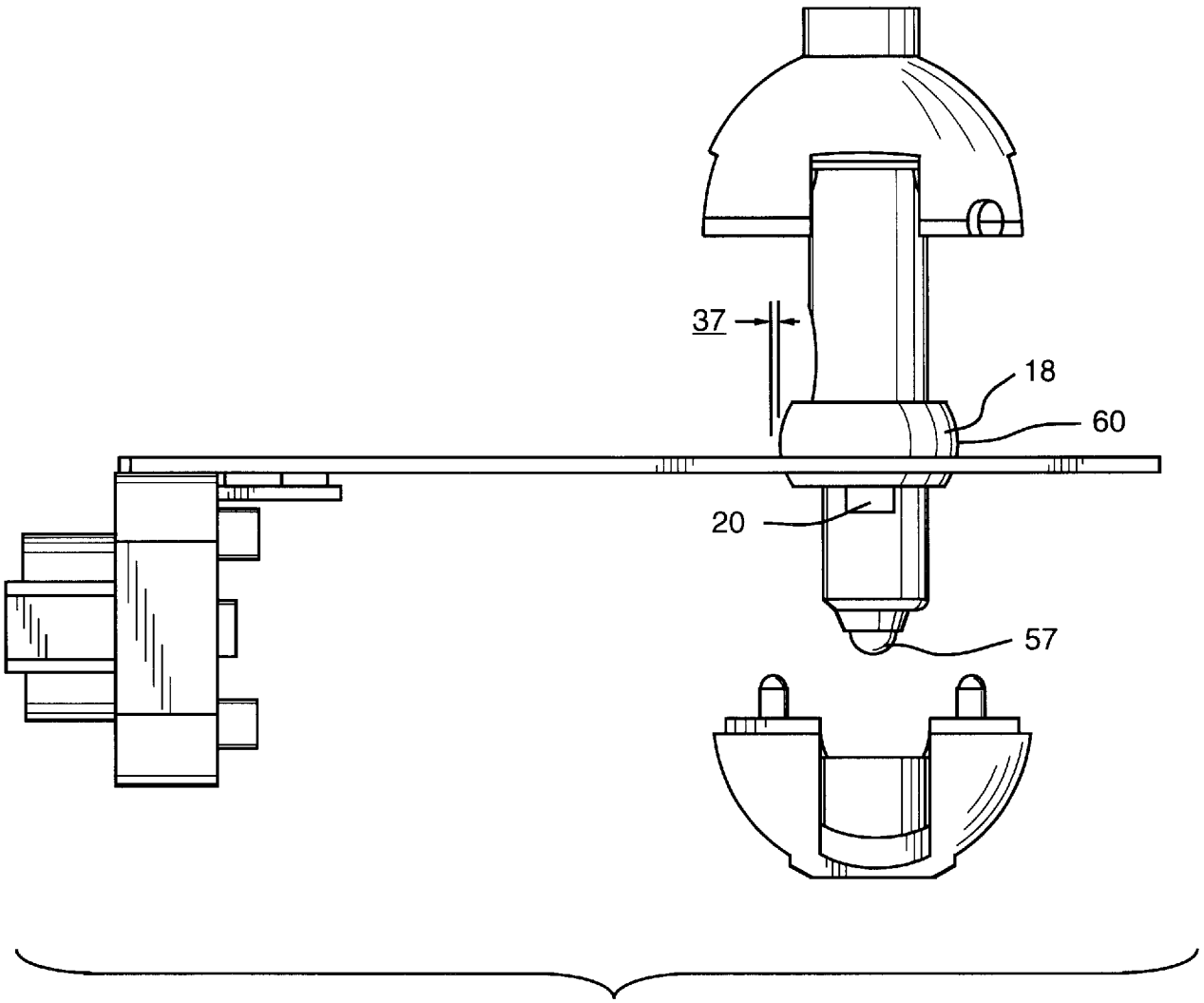
FIG. 4 is an exploded elevation view of the magnet, drive arm, ball halves, printed circuit board and sensor orientation as incorporated in the present invention.

As shown best in FIGS. 3 and 4, the spherical center of the magnet 18 is located at the central axis of the joystick and the spherical center of the upper and lower ball halves 17 and 19, and thereby maintains a fixed air gap between the magnet 18 and sensors 20 for all of the available angular displacements of the drive arm 16 from the neutral central axis 31. Thus, improvement in simplicity and reliability is provided over prior art where lever arms and gimbals were required on each axis of rotation to locate the magnet relative to the sensor.

Another advantage, as shown best in FIGS. 3 and 4, is that there is no requirement for flux concentrators in the present invention to provide adequate magnetic strength to the sensors 20.

Figure 2:
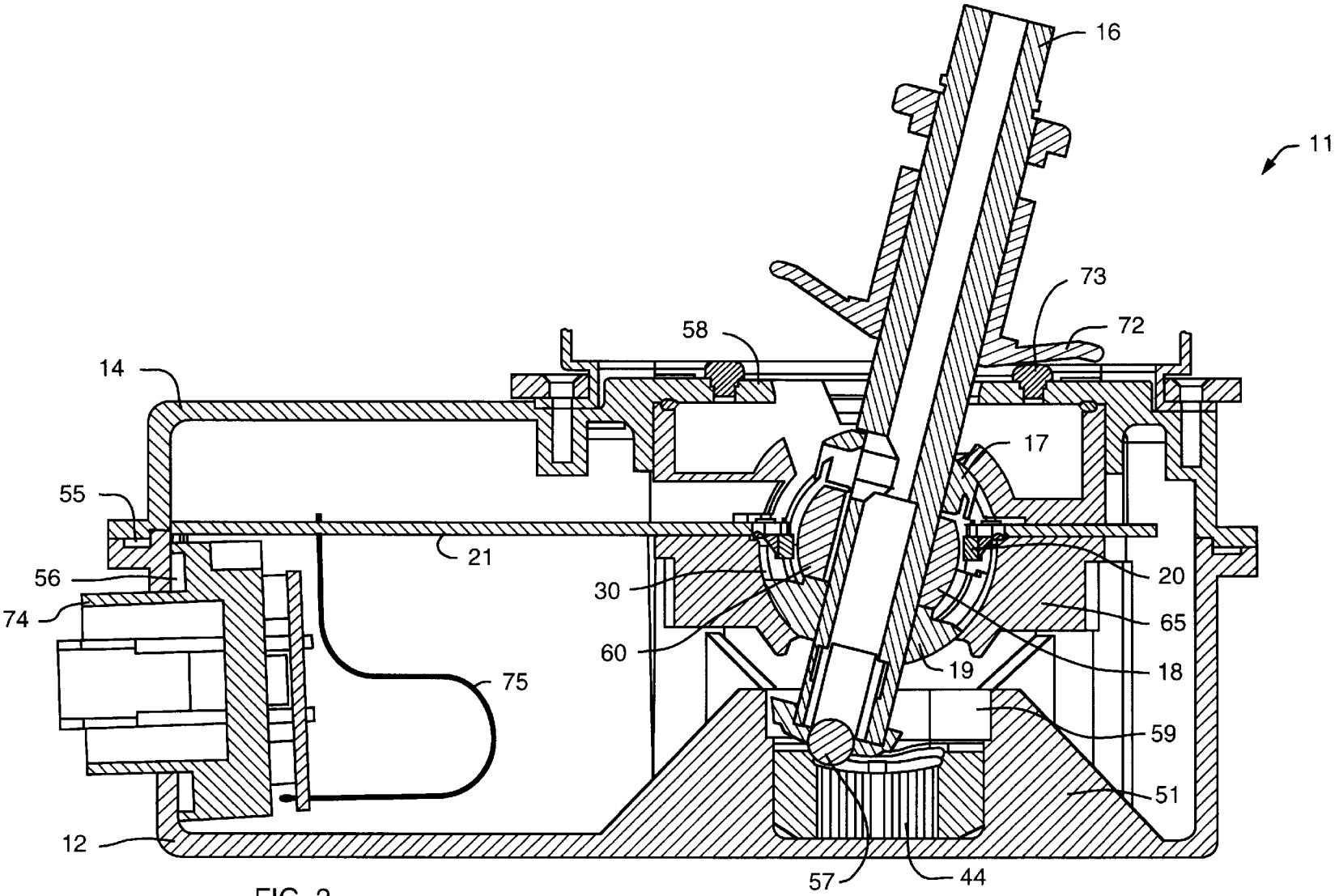
FIG. 2 is a partial sectional view of a joystick shown with one pivotal axis shown rotated at an angle relative to the neutral position.

From FIGS. 1 and 2, the basic principles of operation of the two-axis angular position sensor 10 may be understood. In particular, the two-axis angular position sensor 10 includes the magnet 18, preferably shaped as a ring or circular disc with a primarily spherical outer surface 60 with the axis of the circular shape defining the axis which connects the North and South magnetic poles. As will be discussed in more detail below, the magnet 18 is mounted on a drive arm 16 for pivoting about the center of the pivot 32 that is primarily located at the center of the spherical radius of the magnet 18. The drive arm 16 has a neutral central axis and is fitted with a handle for operator manual control. It is preferably constructed from non-magnetic material in order to effect the most uniformly symmetrical and highest strength magnetic field around the outer perimeter of the magnet. The drive arm can be pivoted primarily in a plane 33 defined by the X axis 35 and neutral axis 31, and in a plane 34 defined by the Y axis 36 and the neutral axis 31, or at any angular position around the neutral axis 31 as shown best in FIG. 5.

Figure 6:
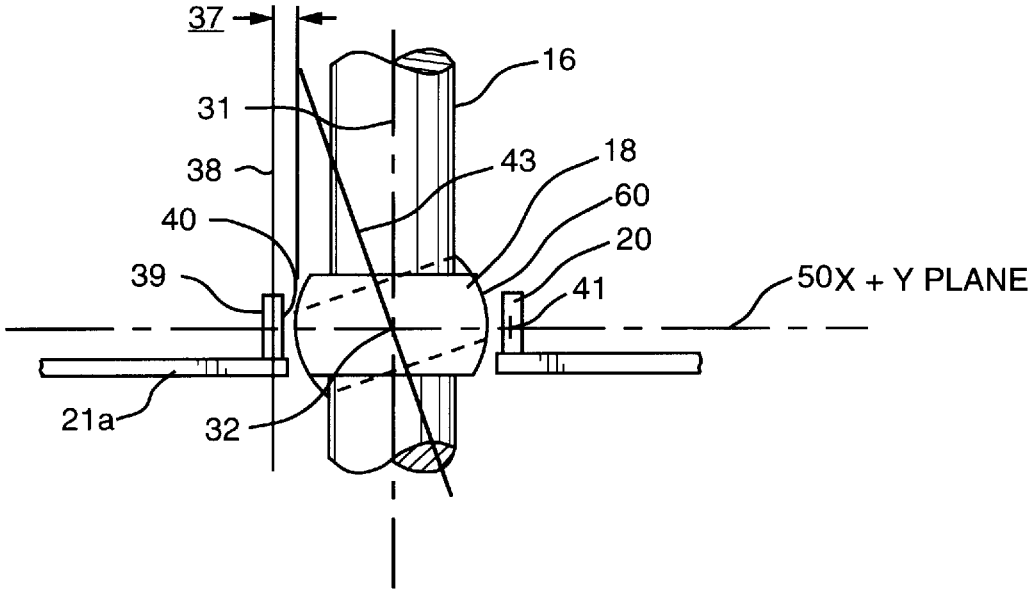
FIGS. 6 and 7 are fragmentary views showing the magnet, sensing element, and magnetic field relationship.

Each magnet sensing element 20 is preferably a Hall effect IC with chip amplifier circuits, for example, an Allegro Model No. 3506, 3507, 3515, or 3516, marketed by Allegro Microsystems, Inc. As best shown in FIG. 3 and FIG. 6, each magnetic sensing element 20 is mounted fixedly relative to the housing 11 beneath tongues, typically shown at 21A, formed on the circuit board 21. The tongues 21A extend radially into an opening formed in the printed circuit board 21. Air gaps 37 are formed relative to the outer surface of the magnet 60 when the magnet 18 and drive arm 16 are in line with the neutral axis 31. In particular, the magnetic sensing element 20 is disposed such that the sensing plane 38 defined by the magnetic sensing element 20 is generally parallel to the neutral axis 31 as defined by the neutral position of the drive arm 16, and generally perpendicular to the plane in which the sensor is used to sense the rotation of the magnet 18. In such an embodiment, the sensing plane 38 is defined as a plane generally parallel to opposing surfaces 39 and 40, shown in FIG. 6. As best shown in FIG. 6, a typical magnetic sensing element 20 is disposed such that the X axis 35 and the Y axis 36 define a plane 50 that preferably passes through the midpoint 41 of the sensing element 20.

Figure 5:
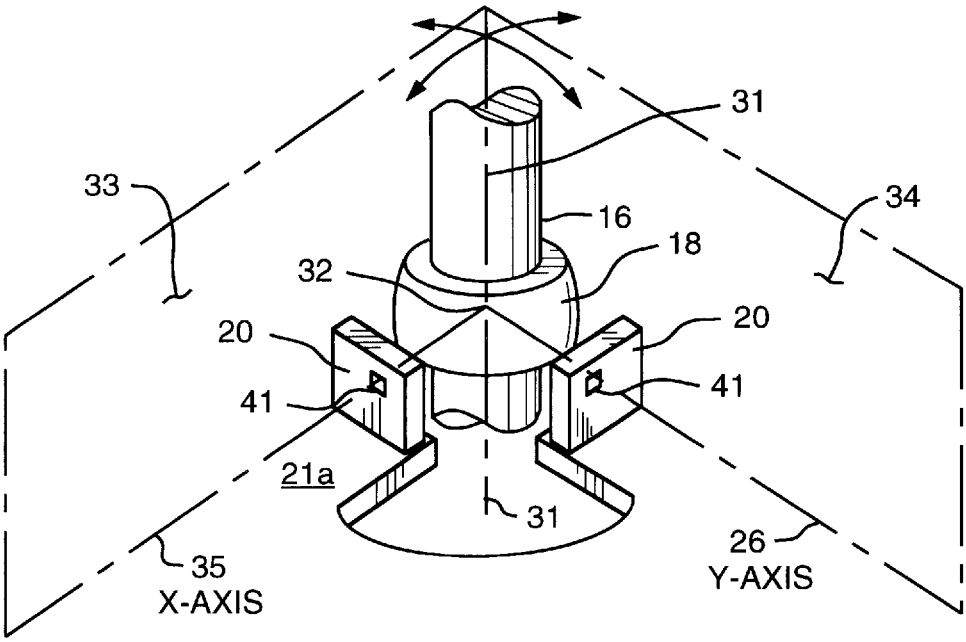
FIG. 5 is a perspective view of the drive arm 16 and magnet 18 shown with respect to the primary planes involved in the operation of the present invention.
Figure 7:
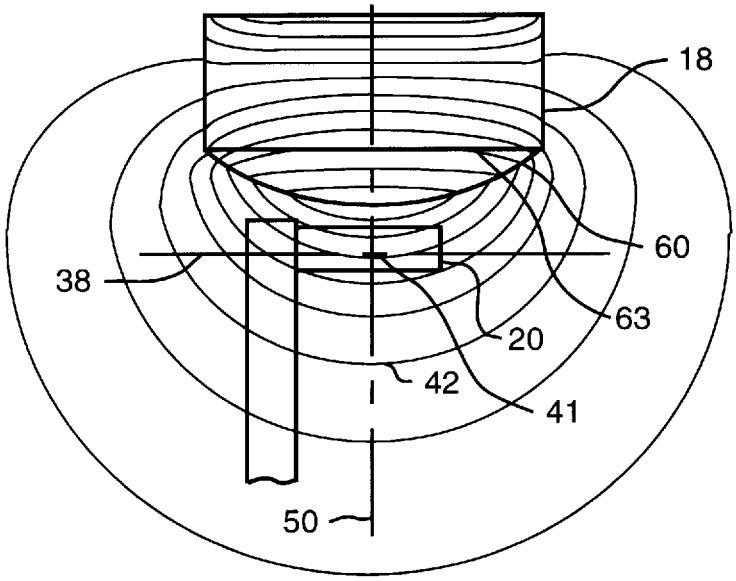

As shown in FIG. 6 and FIG. 7, the two axis angular position sensor 10 is in the quiescent state. In this state, the magnet flux density B, represented by the lines 42, is generally parallel to the sensing plane 38 of the magnetic sensing device 20. In this state, the magnetic sensing element 20 outputs a quiescent voltage. For an Allegro No. 3516 Hall effect IC, the quiescent output voltage is typically about 2.5 volts DC. Rotating the magnet 18 clockwise as shown in FIG. 2 or counterclockwise as shown in FIG. 5 causes an ever increasing amount of magnetic flux density 42 to be applied to the sensing plane 38 of the magnetic sensing element 20 to vary the output voltage of the magnetic sensing element 20 as a function of an angle $\phi$ defined between the neutral axis 31 parallel to the sensing plane 38 and an axis 43 (FIG. 5). For an Allegro No. 3516 Hall effect IC, the output voltage swing is approximately ±2.0 DC depending on the direction of the angular rotation.

Also in accordance with the present invention, the sensing output for each axis of rotation, as discussed previously, is at the quiescent voltage at the neutral axis position or the quiescent state, and the voltage output as a function of angle for each axis is primarily linear as discussed previously for a single axis.

In accordance with another important aspect of the invention, the angular rotation of the magnet 18 about one axis does not generally affect the output of the sensor 20 for the perpendicular axis, so that for any angular position of the drive arm 16 in the X plane 33 the electrical output from the magnetic sensing device 20 in the Y plane 34 will not be changed significantly.

Figure 8:
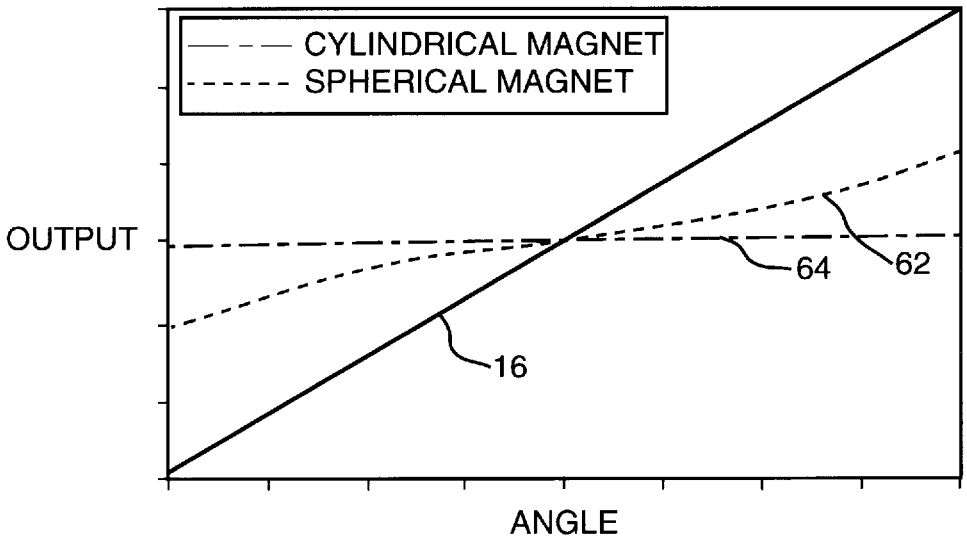
FIG. 8 is an exemplary graph illustrating the relationship between the output voltage of the angular position sensor versus degrees of rotation.

Another important aspect of the invention stems from the fact that the output voltage of the two-axis angular position sensor 10 is fairly linear as a function of the angular rotation of the magnet 18. As such, the output voltage of the angular position sensor 10 can be applied directly to the circuit for the controller without the need for additional and expensive external circuitry. In particular, known two-axis angular position sensors have utilized various circuitry including microprocessors to linearize the output voltage, which adds to the complexity and cost of the sensor. The two-axis angular position sensor 10 in accordance with the present invention eliminates the need for such external circuitry. More particularly, FIG. 8 illustrates a graph of the output voltage of the two-axis angular position sensor 10 as a function of the degrees of rotation. The solid line 61 represents the output voltage of the magnetic sensing element 20 when a magnet 18 with a primarily spherical outer surface 60 is utilized to sense the angular position in one of the two perpendicular planes 33 or 34. The dashed line 62 represents the voltage of the magnetic sensing element 20 when a magnet 18 with a cylindrical outer surface 63 is utilized, and shows clearly the improvement in the linearity and the increase in the output of the sensor 10 that utilized the primarily spherical outer surface 60. As illustrated, the solid line is fairly linear over the anticipated operating range of the sensor, for example, up to 70° rotation. The dash-dot line 64 represents the output voltage of the magnetic sensing element 20 utilized to sense the angular position along the perpendicular plane. As illustrated, the dash-dot line primarily remains at a constant voltage output throughout the entire range of angular rotation.

As shown in FIG. 1, the upper ball housing 13 and the lower ball housing 65 create the socket in which the ball pivots. Upstanding walls 51 form an open-topped square receptacle in the base 12, at the bottom of which an inner detent block 44 and an outer detent block 45 are disposed. The mating surfaces for the pivotally mounted assembly described above are chosen to minimize the friction and wear on the pivot surface 30.

The cover 14 having a central opening for the drive arm 16 is placed on the upper ball housing 13. The cover 14, also having internal structural ribs completes the enclosure about the drive arm 16. A central opening is formed through the cover 14 through which the drive arm 16 emerges to be fitted ergonomically into a handle for operator control of the joystick. The handle may be provided with momentary contact switches which are wired through the drive arm 16 to actuate equipment elements.

The drive arm 16 is surrounded by an outer flexible rubber boot 52 and an inner flexible boot 53, which protects the enclosure from the environment. These are not shown in FIG. 2 for purposes of simplification of the drawing, but they are designed to compress in accordian fashion as the joystick is moved angularly. Also, a shroud 54 having a flange 72 protects the interior when the drive arm is in the neutral position. The joystick drive arm 16 is surrounded by the flange 72 which contacts a pivot ring 73 when the joystick is at an angle to the housing as seen in FIG. 2. The ring 73 serves as a bumper and is preferably made of non-magnetic plastic material inserted in a suitable circular slot formed in the cover 14. A compressed gasket 55 provides a seal between the cover 14, and the base 12. A sealing gasket 56 is also provided between the electrical connector 74 and the base 12, and between any other thru-hole device that may be required for the customer, such as momentary contact switches to actuate equipment elements. The electrical connector 74 may be connected to the circuit board 21 by a flex strip 75. Sealing provided by the rubber boots about the shaft and the gaskets as discussed previously permits the unit to withstand severe environmental conditions.

Figure 9:
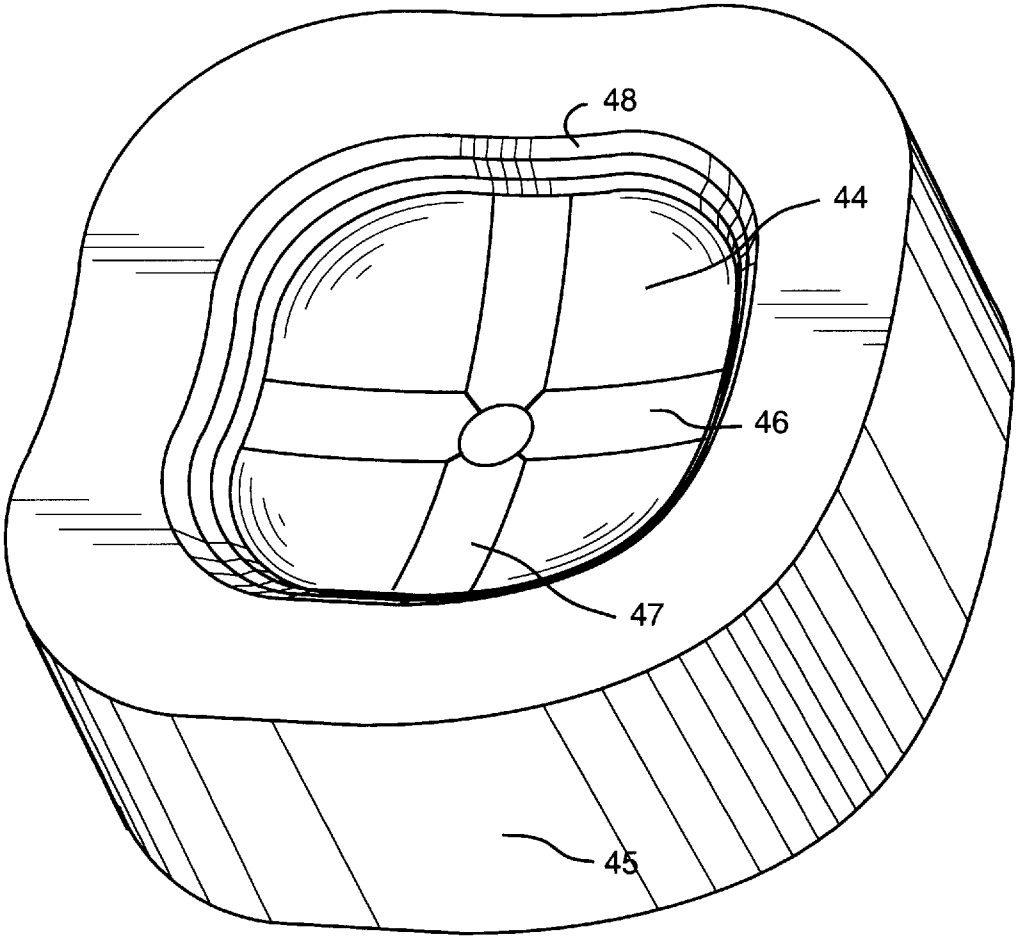
FIG. 9 shows the interdent block that contacts the bottom of the joystick.

The inner detent block 44 is made preferably of unfilled nylon and the outer detent block 45 is preferably made of metal and are shown separately in FIG. 9. The inner detent block 44 is generally spherical and has a contoured surface which includes transversely arranged tracks, namely, the X-rail 46 and the Y-rail 47. Also, a step 48 is formed about the periphery of the inner detent block 44 by a raised spherical surface in the outer detent block 45, to indicate the end of travel detent and for possible locking.

The ball 57 is urged resiliently by a coiled spring, for example, against and travels over the contoured surface of said inner detent block 44 in any direction outwardly from the center, it reaches the step 48, when the joystick is at an angle from neutral axis, providing a detent feel to the operator to indicate it is reaching the end of its travel. Also, as the ball 57 moves in or out of the tracks 46 and 47, the operator manipulating the joystick by its handle senses the detent and the location of the neutral axis.

The angular position sensor 10 by virtue of the strengthening structural ribs in the base 12, the cover 14, and the interior walls and ribs withstands loads of up to 200 lbs. in the push/pull and tangent directions at the end of a lever arm 6" long. The enclosure which forms the socket for the pivot ball includes the upper ball housing 13 and the lower ball housing 65 which distributes the load over a relatively large surface, which in turn transmits all loads to the rugged base-cover assembly. Also, when the drive arm 16 reaches its extreme position, it encounters a stop 58 which is formed on the cover 14, permitting forces applied to the drive arm 16 to be transmitted to the cover. Also, when the drive arm 16 reaches its extreme position, the extension of the drive arm 16 below the lower ball half 19 encounters a stop 59 which transmits forces to the upright walls 51 of the base 12. These two stops, being on the opposite sides of the pivot point 32, provide a reaction moment that counteracts the applied forces to the drive arm 16 that is sufficiently long to reduce the force levels to manageable levels.

What is claimed is:

1. In a joystick control system which comprises: a handle, a housing having a base and cover with an opening formed therethrough to accommodate said handle, a generally spherical socket formed in said housing, a relatively large pivot ball mounted on said handle and rotatable in said socket, a spherical magnet disposed in said pivot ball, the centers of said spherical magnet and said pivot ball being coincident, magnetic sensing elements disposed at a fixed distance from said magnet and means electrically connected to said magnetic sensing elements to provide a signal representative of the orientation of said joystick.

2. In a joystick control system as defined in claim 1, wherein a first portion of said handle extends upwardly from said pivot ball and a second portion of said handle extends downwardly from said pivot ball, a detent ball mounted on the lower end of said joystick, a detent block having a contoured surface disposed in said base, said detent ball being urged against said contoured surface of said detent block and providing a physical indication of joystick orientation based on points of contact of said detent ball with predetermined areas of said contoured surface.

3. In a joystick control apparatus as defined in claim 2, the combination in which said magnetic sensing elements include Hall-effect devices magnetically coupled to said magnet without physical contact therebetween.

4. In a joystick control apparatus as defined in claim 2, the combination wherein said detent block has a generally concave upper surface, mutually perpendicular X-axis and Y axis tracks being formed centrally of said surface, and a raised step being formed about the periphery of said block.

5. In a joystick control apparatus as defined in claim 1, the combination wherein said pivot ball has a plurality of radial openings formed therethrough, radial tongues being formed on a member fixed in said housing, said radial tongues extending into said radial openings and supporting said magnetic sensing means in proximity to said magnet.

6. In a joystick control apparatus as defined in claim 5, the combination in which said pivot ball comprises two spherical ball halves joined about and substantially enclosing said magnet.

7. In a joystick control system as defined in claim 1, the combination wherein said handle has a central axis which passes through the center of said spherical magnet and said pivot ball, and said magnetic sensing elements are fixed in position in said housing whereby a substantially fixed gap exists between said spherical magnet and said magnetic sensing elements irrespective of the orientation of said handle in said housing.

8. In a joystick control system as defined in claim 7, the combination in which said spherical socket comprises an upper ball housing disposed beneath said cover and a lower ball housing formed on said base.

* * * * *